US007959032B2

(12) United States Patent
Bolli

(10) Patent No.: US 7,959,032 B2
(45) Date of Patent: Jun. 14, 2011

(54) RECLOSABLE POURING ELEMENT AND METHOD FOR ASSEMBLING SAID ELEMENT

(75) Inventor: Felix Bolli, Beringen (CH)

(73) Assignee: SIG Technology AG, Neuhausen am Rheinfall (CH)

( * ) Notice: Subject to any disclaimer, the term of this patent is extended or adjusted under 35 U.S.C. 154(b) by 688 days.

(21) Appl. No.: 11/916,756

(22) PCT Filed: Mar. 29, 2007

(86) PCT No.: PCT/EP2007/053046

§ 371 (c)(1),
(2), (4) Date: Dec. 6, 2007

(87) PCT Pub. No.: WO2007/113215

PCT Pub. Date: Oct. 11, 2007

(65) Prior Publication Data

US 2009/0020558 A1 Jan. 22, 2009

(30) Foreign Application Priority Data

Mar. 31, 2006 (DE) ..... 10 2006 015 525

(51) Int. Cl.
*B67D 1/00* (2006.01)

(52) U.S. Cl. ..... 222/93; 220/277

(58) Field of Classification Search ..... 222/83, 222/83.5, 85–91; 220/251–253, 258.4, 267, 220/277, 278; 215/257
See application file for complete search history.

(56) References Cited

U.S. PATENT DOCUMENTS

| | | | | |
|---|---|---|---|---|
| 6,279,779 | B1 * | 8/2001 | Laciacera et al. | 222/83 |
| 6,820,764 | B2 * | 11/2004 | Miani et al. | 222/83 |
| 6,851,576 | B2 * | 2/2005 | Dubach | 222/83 |
| 7,207,465 | B2 * | 4/2007 | Weist | 222/83 |
| 7,458,486 | B2 * | 12/2008 | Weist et al. | 222/83 |
| 7,490,736 | B2 * | 2/2009 | Moulton | 222/83 |
| 2006/0261028 | A1 * | 11/2006 | Dubach | 215/257 |

FOREIGN PATENT DOCUMENTS

| | | | | |
|---|---|---|---|---|
| EP | 1262412 | A1 | 12/2002 | |
| EP | 1591367 | A1 | 2/2005 | |
| EP | 1571095 | A1 | 9/2005 | |
| JP | 2005-324831 | * | 11/2005 | 222/83 |
| WO | 03/101843 | A1 | 12/2003 | |
| WO | 2004/083055 | A1 | 9/2004 | |
| WO | WO-2006/050624 | * | 11/2005 | 222/83 |

* cited by examiner

*Primary Examiner* — Lien T Ngo
(74) *Attorney, Agent, or Firm* — The Webb Law Firm

(57) ABSTRACT

A re-closable pouring element for liquid food packaged in cardboard/plastic composite packages, comprising a base encircled by a flange and having both a solidly constructed inner thread and an outer thread, an opening element having at least one cutting edge and a screw cap formed as a threaded lid. The opening element has a solidly constructed outer thread and is arranged inside the base. The opening element is formed in such a way that when the screw cap is operated for the first time, it cuts an opening in the package material located under the pouring element.

15 Claims, 6 Drawing Sheets

RECLOSABLE POURING ELEMENT AND METHOD FOR ASSEMBLING SAID ELEMENT

BACKGROUND OF THE INVENTION

1. Field of the Invention

The invention relates to a re-closable pouring element for liquid food packaged in cardboard/plastic composite packages including a base, encircled by a flange and having both a solidly constructed inner thread and an outer thread, an opening element having at least one cutting edge or the like and a screw cap formed as a threaded lid, wherein the opening element has a solidly constructed outer thread and is arranged inside the base and wherein the opening element is fanned in such a way that when the screw cap is used for the first time, it cuts an opening in the material of the package located under the pouring element.

2. Description of Related Art

Re-closable pouring elements for liquid food packaged in cardboard/plastic composite packages of various configurations are known in practice. On the one hand they serve for first-time opening of the packages and in the configuration of interest here are fitted from the outside onto the already filled and closed package. The package material in the region of the (later) opening for pouring frequently has a weakened area for this purpose. This can be formed either as a perforation of the material or however as an opening for pouring in the substrate (cardboard), which when the inner and outer plastic layers are laminated is covered over with plastic, usually polyethylene.

In each case it is necessary, when opening for the first time, that a cutting force applied by the user is translated into an opening operation, so that reliable opening of a sufficiently large opening for pouring is ensured. Besides pouring elements with swivelling opening elements, in particular such pouring elements, which are provided with a screw cap as lid and whereby twisting off the screw cap for the first time causes corresponding turning of a ring-shaped opening element into the package material, have proven satisfactory.

A generic pouring element of this kind is disclosed in EP 1 088 764 A1. It consists of a base, encircled by a mounting flange, having a hollow-cylindrical opening element arranged therein and a screw cap, wherein the three individual parts are coordinated with one another, so that when the pouring element is opened for the first time, by means of positive connection between screw cap and opening element, a helical movement of the opening element and thus creation of an opening for pouring results. Three-part pouring elements of this kind require to a certain extent a not insignificant amount of time and expense for their assembly. It is clear that the known pouring element apart from its complex assembly cannot be arbitrarily formed to be small, for example to be used with correspondingly small package sizes such as 0.2 or 0.25 liters. Since such small package sizes have a relatively narrow head area, it is no longer possible during production of the packages to work with covered over openings for pouring. The known three-part pouring element however is only able to open a covered over opening for pouring.

EP 1 262 412 A1 discloses a pouring element wherein openings are provided in the wall of the opening element, in the region of which the outer thread of the opening element is interrupted. This however is "coerced interruption", which does not have anything in common with easier assembly.

Another pouring element is disclosed in EP 1 571 0 95 A1. Openings which serve as interlocking elements for an active material present in the pouring element are also arranged here in the opening element. It is clear that the threaded sections are also interrupted here in the region of the openings, however again conditioned by coercion and not for easier assembly of the individual parts.

WO 03/101843 A1 describes a three-part pouring element, wherein however the opening element is not moved by screwing. Here the actual opening operation consists in a combination of a piercing and a rotating motion, thus superimposition of an axial and a radial movement.

SUMMARY OF THE INVENTION

The object of the invention therefore is to configure and refine the pouring element mentioned at the outset and previously described in detail so that it is able with as simple an assembly as possible, to reliably pierce the composite material of a drinks package even without previous weakening and to create a sufficiently large opening for pouring.

This object is achieved with a pouring element according to one of the claims wherein the outer thread of the opening element is reduced or interrupted in the lower section at least in one region so that the inner thread of the base is likewise reduced or interrupted at least in a corresponding region, which means that during initial assembly the opening element can be moved into the base axially from above without screwing in, pressing in or over-compressing the threads.

The invention recognized that it is possible to carry out assembly of the opening element and base without pressing in and over-compressing the threads. As a result of the corresponding reductions or interruptions it is no longer necessary to screw the opening element into the base during initial assembly. Because the threaded sections of the pouring element according to the invention are coordinated with one another, it is achieved that the opening element is firstly moved—radially aligned accordingly—into the base axially from above and that the cap can be fitted at the same time or afterwards. Time-consuming screwing of the opening element into the base can be completely eliminated. Due to the bayonet-type engagement of the thread when the screw cap is operated for the first time, the opening element is turned and, already after turning a short way, the positive connection of the threads coordinated with one another results in helical-type penetration of the cutting edge of the opening element into the package material.

In accordance with a further teaching of the invention it is proposed that the outer thread of the opening element is reduced or interrupted at two opposite regions. In this way very good torque distribution is possible, since the opening element is reliably guided inside the base. Advantageously the base also has two diametrically opposed threaded sections in its interior.

A further arrangement of the invention provides that the outer thread of the opening element has two interlinking threads. This embodiment permits the threads to be configured relatively steeply so that a sufficiently large force can be applied on the cutting edge of the opening element when cutting into the package material for the first time. Particularly preferably each thread embraces the opening element by at least 540° (1½ times), so that the opening element can be rotated more than 360° when the cap is first screwed on.

According to another teaching of the invention the outer thread of the opening element in each case is reduced or interrupted in the lower thread. In this way it is achieved that already after turning the screw cap and therefore the opening element just a short way, engagement in four different places of the thread occurs, so that the necessary piercing and cutting force can be applied.

Moreover a further arrangement of the invention provides that the at least one cutting edge is suitable both for piercing the cardboard/plastic composite material and for cutting out an opening for pouring. The cutting edge is preferably formed so that when turning into the package material, the cut length for forming the opening for pouring is less than a complete circle.

As the result of a cutting edge formed accordingly, the torn out piece of composite package is not entirely detached from the remaining composite material, but is swivelled laterally inwards and fixed there by the opening element projecting in the manner of a tube into the package interior, so that the entire clear cross section of the opening element is available as an opening for pouring. It can be realised either by an axial length of the cutting edge, which is smaller than the axial length of a thread or however by a cutting edge correspondingly bent inwards, so that the radius of the torn out piece of composite material is not of equal size, but slowly becomes larger.

According to another embodiment of the invention the base has several threaded sections in the interior, in each case diametrically opposed. The arrangement of these threaded sections is selected so that when the opening element is axially inserted the reduced or interrupted regions of the threads of the opening element can be moved past the threaded sections arranged inside the base. The outer thread of the opening element and the inner thread of the base only intermesh through rotating the opening element by manipulating the screw cap.

Another teaching of the invention provides that at least one limit stop is provided in the lower region of the base for the opening element which is unscrewed downwards. Alternatively the or each outer thread of the opening element can also have at least one limit stop. These limit stops reliably ensure that the opening element cannot enter the package interior.

A plurality of protrusions, which have a hook-shaped cross section and are distributed inside the opening element, serve to move the opening element in the base. The screw cap is accordingly formed so that at least one driving bar is provided in its interior, which bar extends bent concentrically downwards running from the top side of the cap and in this way interacts in a ratchet-like manner with the projections inside the opening element. As a result it is achieved that the opening element in each case is only turned when the screw cap is unscrewed, thus in a counter-clockwise direction. Renewed screwing of the cap causes the at least one driving bar to slide off inwards, so that the opening element remains in its respective position.

Finally it is proposed according to another teaching of the invention that the screw cap is connected to the base in the fitted position by means of material bridges serving as predetermined breaking points. In this case the material bridges preferably run between the cap and a mounting plate which is connected to the flange of the base.

A material of sufficient hardness is used as material for the opening element, in order to be able to make the cutting edge so sharp that an opening for pouring can be cut into the (un-weakened) composite material.

The invention is described below in detail on the basis of a drawing illustrating a single preferred embodiment.

DETAILED DESCRIPTION OF THE INVENTION

Figure 1:
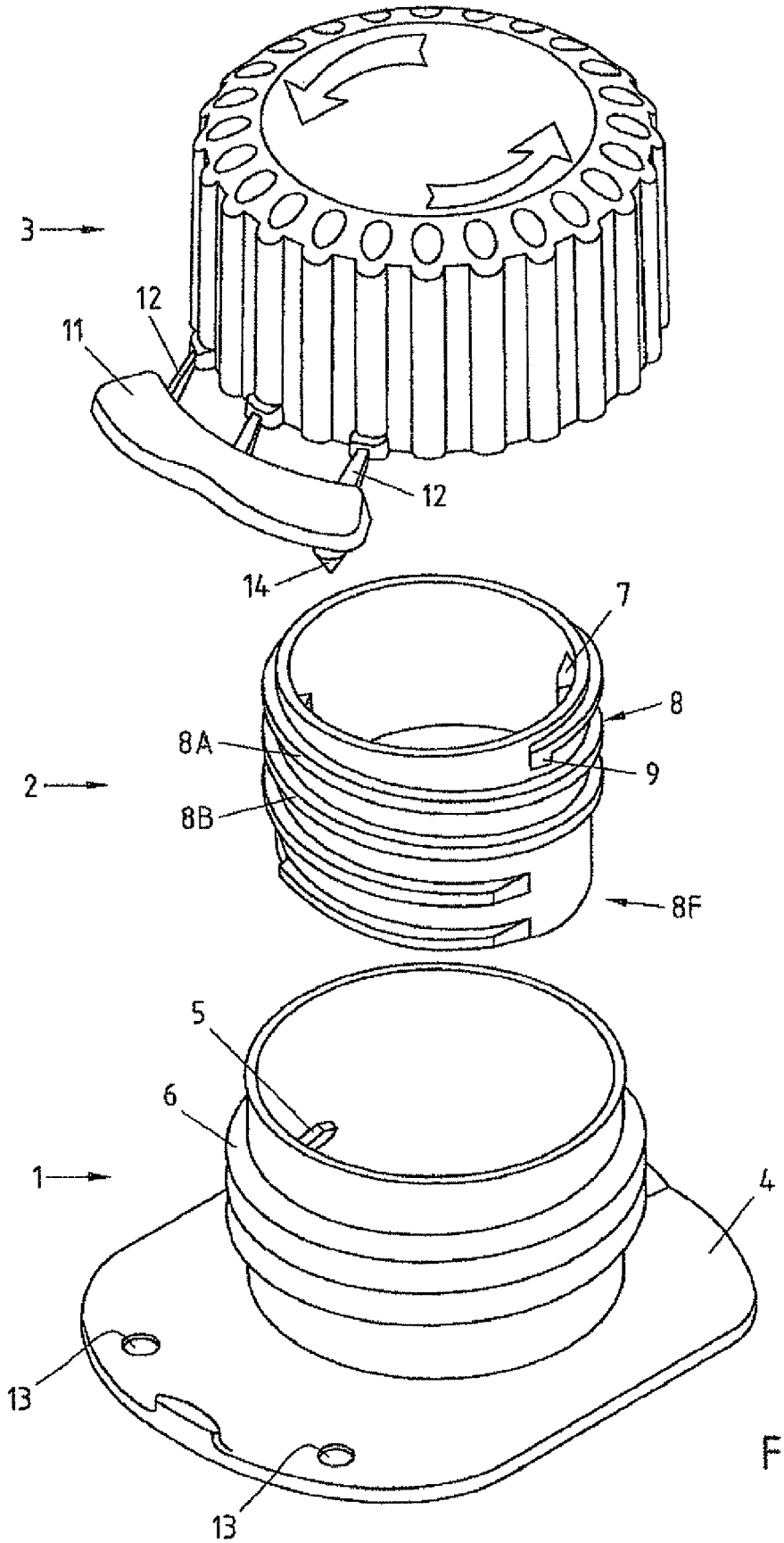
FIG. 1 an embodiment of the pouring element according to the invention before its assembly in perspective illustration, FIG. 2 the finished fitted pouring element viewed in perspective, FIG. 3 the pouring element after first-time opening of the cap viewed in perspective, FIG. 4 the subject matter of FIG. 3 in perspective view from diagonally below, FIG. 5 the pouring element after repeated opening in perspective view from diagonally below, FIG. 6 base and opening element in the fitted position, cut open in perspective view from below and FIG. 7 the subject matter of FIG. 6 after repeated opening, cut open in perspective view.

In FIG. 1 the pouring element according to the invention is illustrated as an exploded view. It essentially includes three different parts, that is to say a base 1, a hollow-cylindrical opening element 2 and a screw cap 3. The base 1 is encircled by a flange 4 and has an inner thread 5, which is described in greater detail later.

The opening element 2 in its interior has two diametrically opposed hook-like projections 7, via which the turning torque necessary for opening is transferred from the screw cap 3 to the opening element 2. On its outside lateral surface the opening element 2 is provided with an outer thread 8, which will also be discussed in greater detail.

Now the outer thread 8 is reduced according to the invention in the lower section, as can be clearly seen in FIG. 1. The reduced regions of the outer thread 8 are preferably at two diametrically opposed regions 8F of the opening element 2.

A limit stop 9, which ensures that the opening element 2 screwed into the package interior cannot fall out of the base 1 and enter the package interior is arranged in each case at the upper end of the outer thread 8, which in the preferred embodiment consists of intermeshing threads 8A and 8B in each case offset by 180°.

Figure 4:
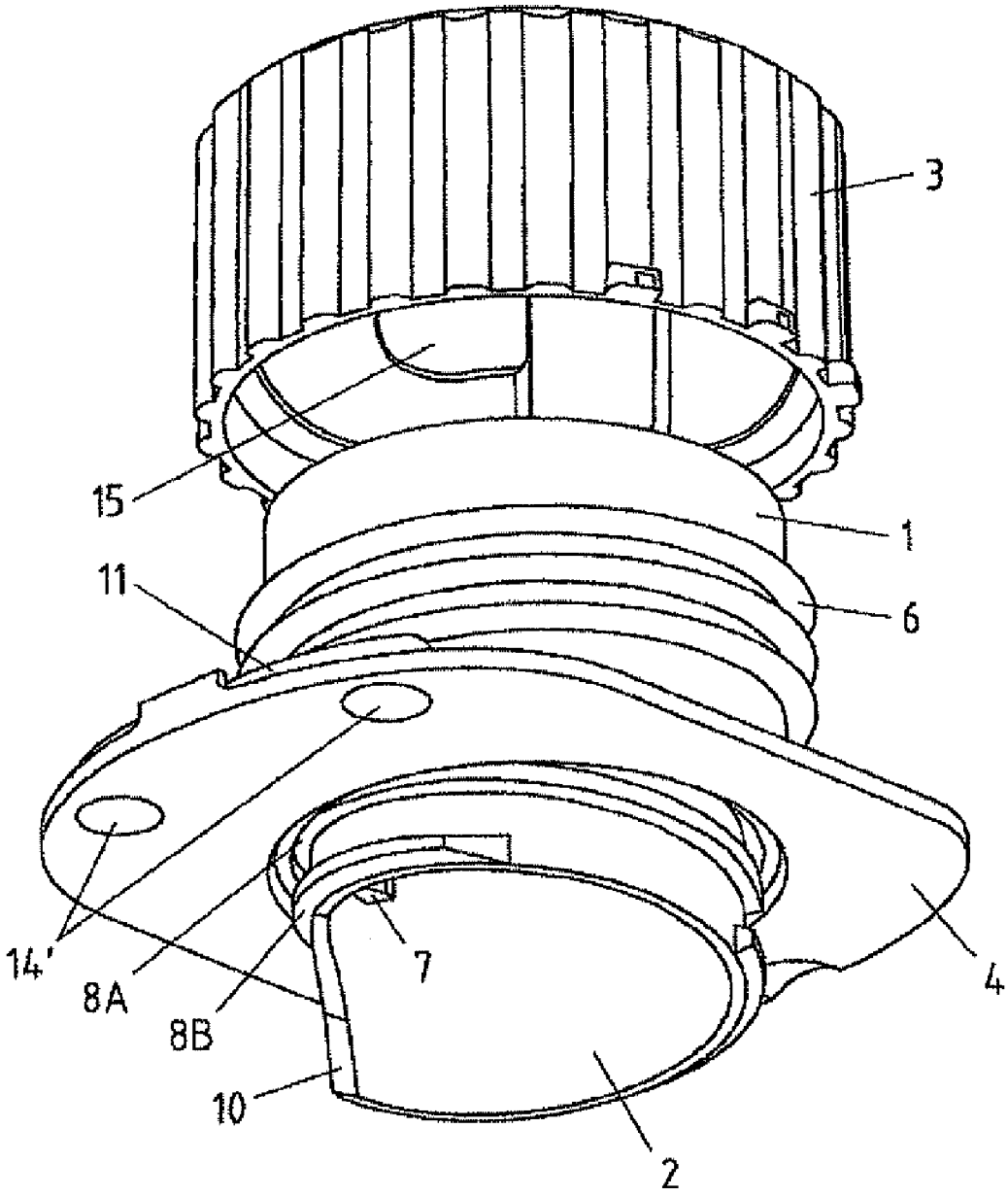

Furthermore the opening element 2 at its lower end has a cutting edge 10, as can be seen particularly clearly in FIG. 4.

Figure 2:
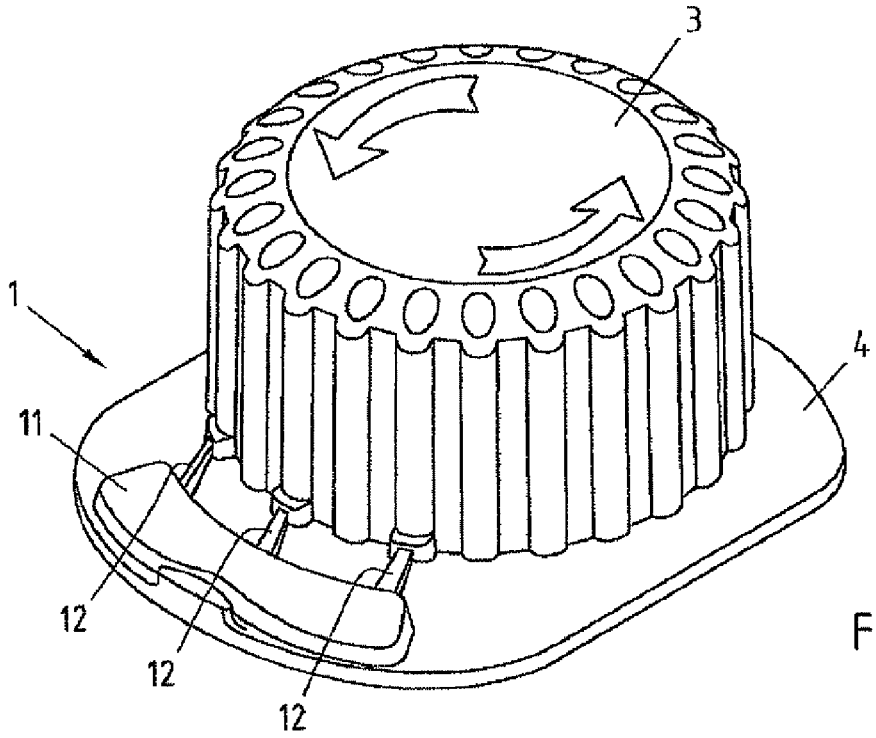

In FIG. 2 the pouring element according to the invention is illustrated in perspective in the finished fitted position. It can be clearly recognized that the screw cap 3 is integrally connected to a mounting plate 11, which is in positive or non-positive communication with the base 1.

Figure 3:
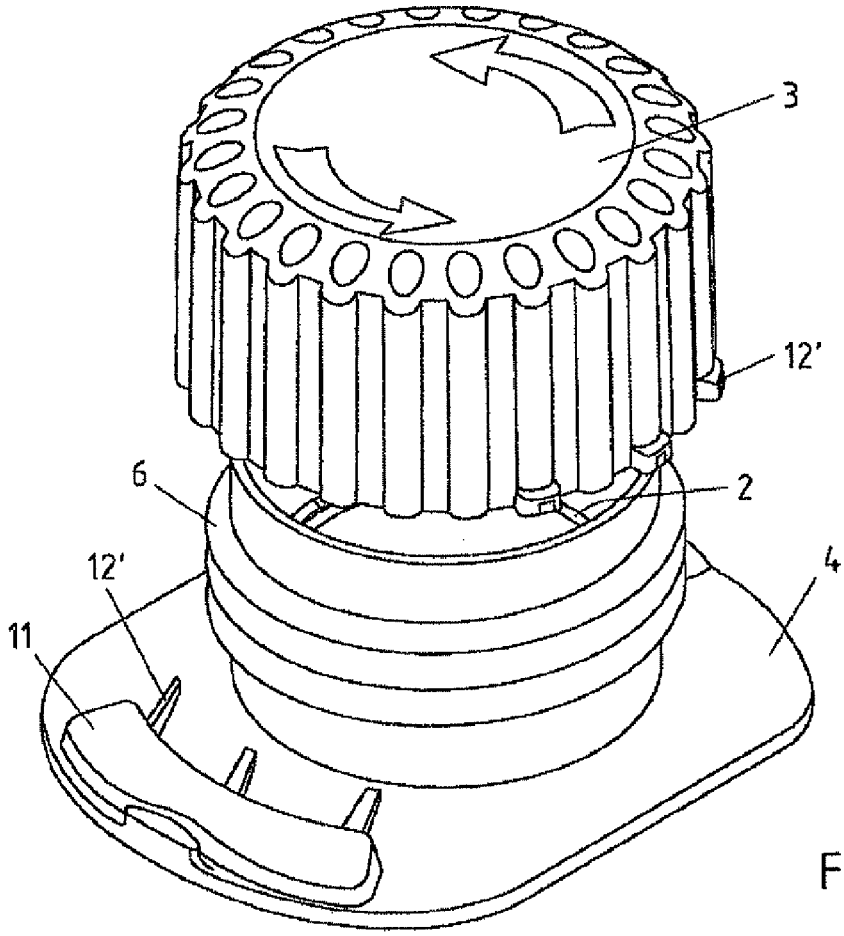

FIG. 3 shows the pouring element in the same perspective view after screw cap 3 has been unscrewed for the first time. Predetermined breaking points in the material bridges 12, connecting the mounting plate 11 and the screw cap 3, tear during opening; in the illustrated and to this extent preferred embodiment the pouring element has three such material bridges 12, the destroyed material bridges 12' being recognizable in FIG. 3.

In FIG. 4 it is evident that the mounting plate 11 is preferably positively connected to the flange 4 of the base 1. To this end two openings 13 extending downwards are provided in the flange 4, in which two connecting spigots 14 (see FIG. 1), running downwards from the mounting plate 11, engage and are caulked there, as indicated by 14'.

From FIG. 4 it is also evident that the screw cap 3 is provided in its interior with two concentric driving bars 15, which project downwards from the lid of the screw cap 3 and through their curved concentric bar shape can transfer turning torques in a torsionally rigid way, but may deviate radially inwards. As a result of this arrangement in conjunction with the hook-shaped arrangement of the projections 7 inside the opening element 2 it is achieved that when opened for the first time, the opening element with its cutting edge 10 cuts an opening into the package material located below the pouring element. However when the screw cap 3 is closed the driving bars 15 are diverted inwards by the corresponding bevels of the projections 7, so that the opening element 2 is not rotated.

Figure 5:
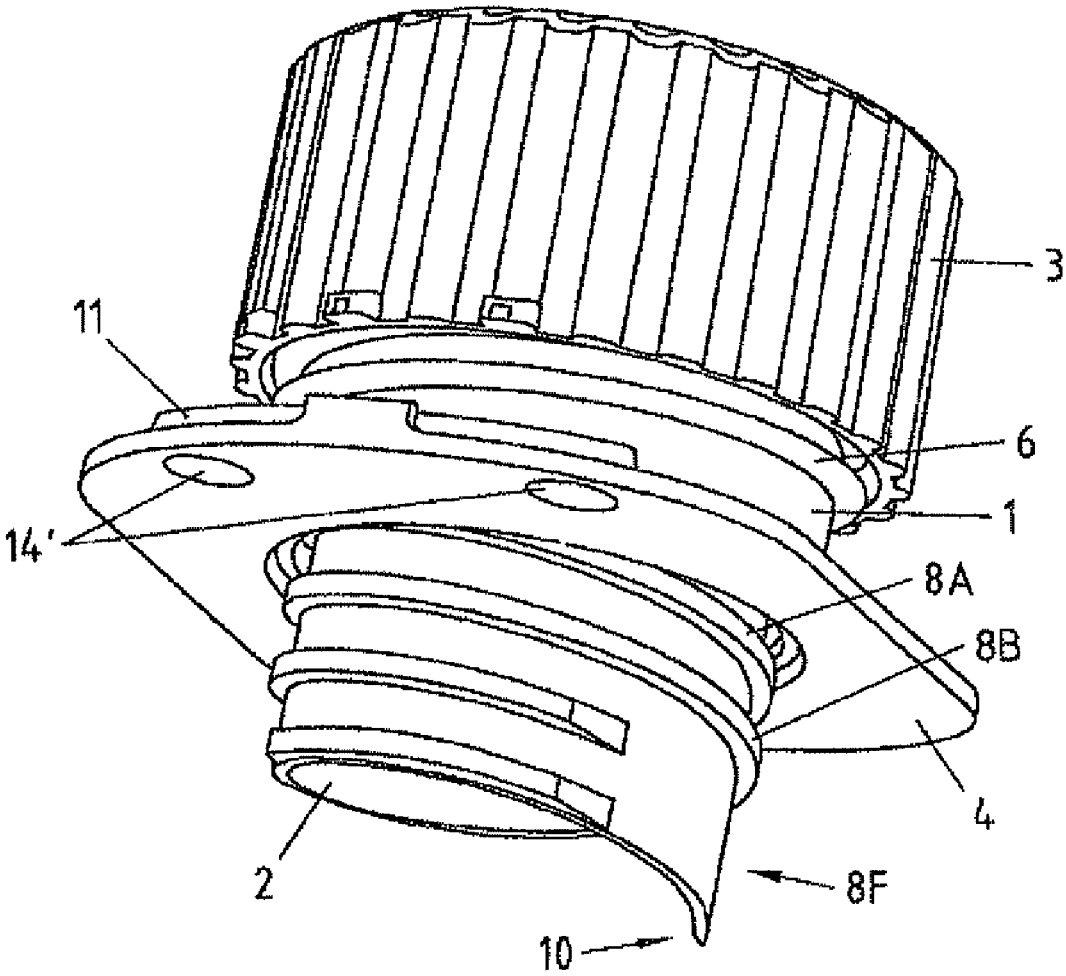

FIG. 5 now shows the opening element 2 in its end position, since with repeated opening however the driving bars 15 as a result of their length again engage behind the hook-like projections 7 and cause the opening element 2 to be still screwed slightly further into the package material than in the position shown in FIG. 4 after first-time opening. Here the opening element 2 has therefore once again completed an approximate 180° rotation.

Figure 6:
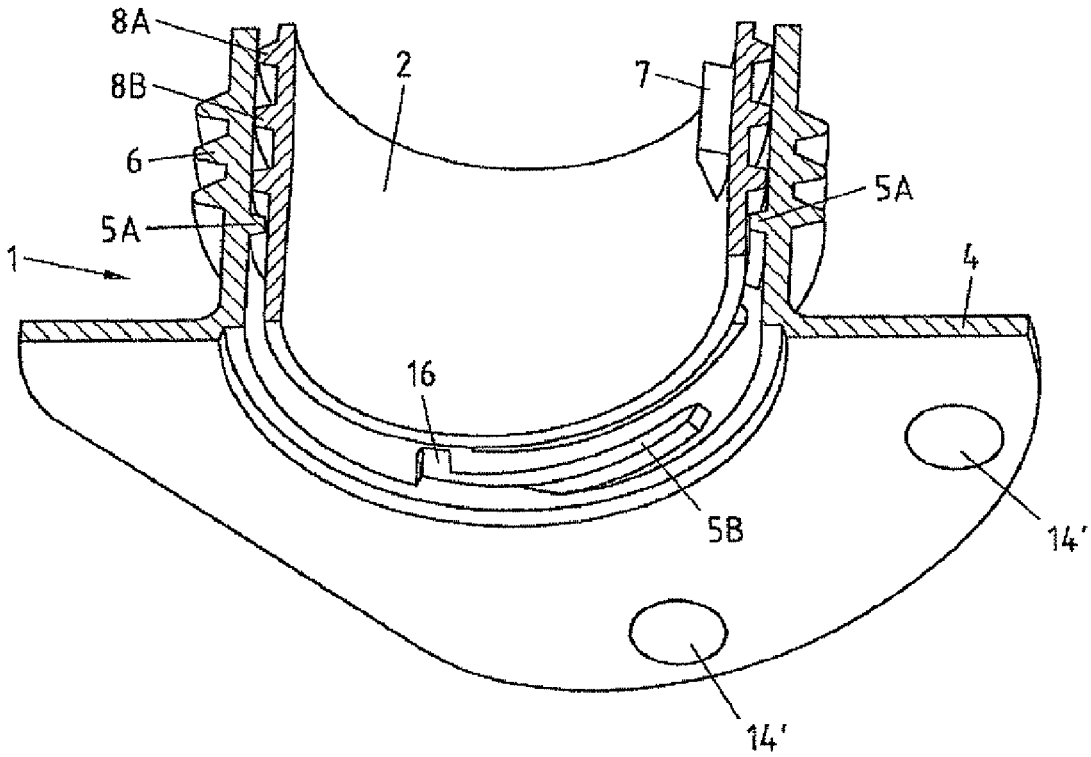
Figure 7:
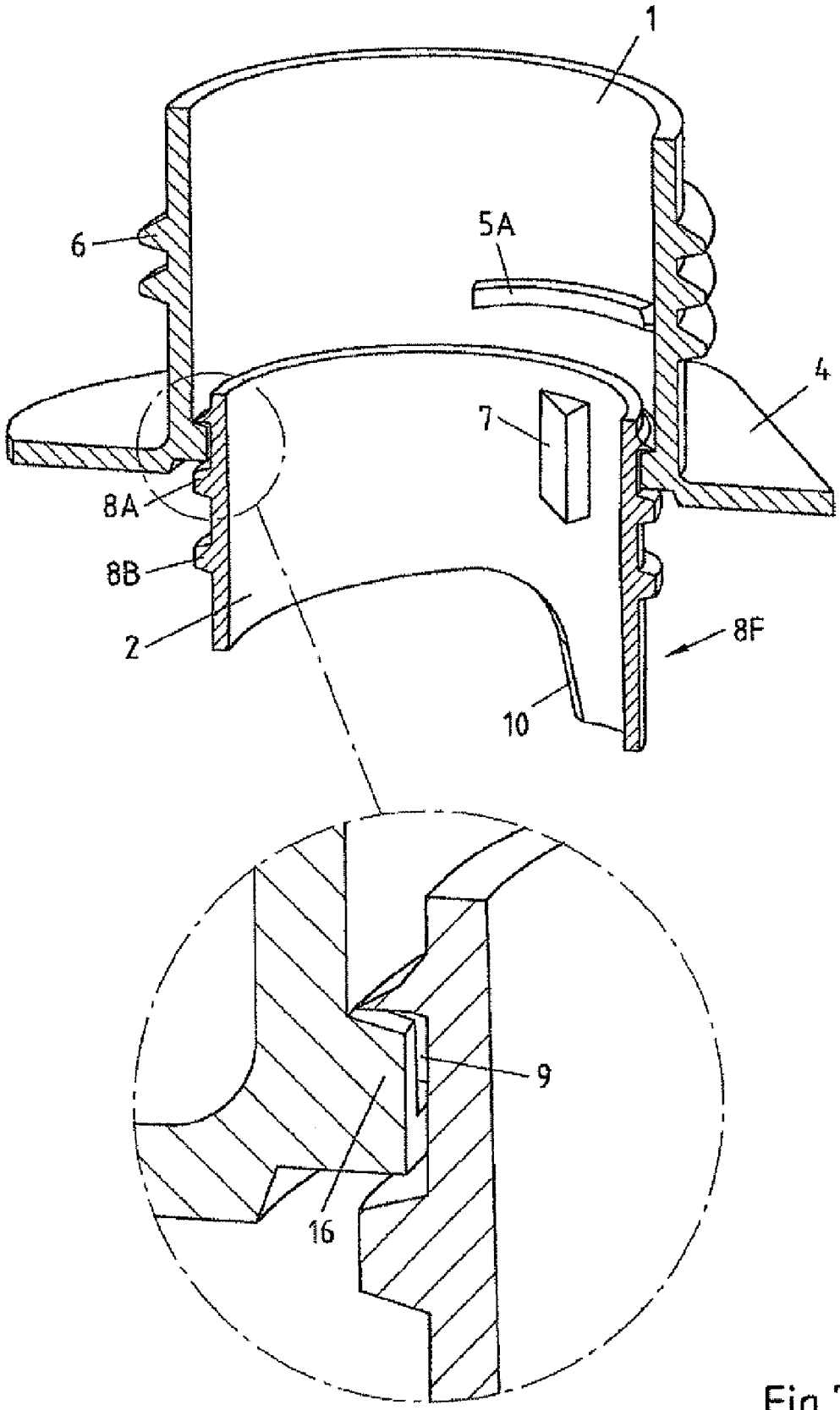

In FIGS. 6 and 7 the functional mode of opening is now explained in detail with sectional views. In FIG. 6 it can be seen that also the base 1 in its interior at the end of the lower thread section 5B likewise has a limit stop 16, which cooperates with the limit stops 9 of the opening element, as can be seen in FIG. 7. In this way it is reliably ensured that the opening element 2 operated by the screw cap 3 cannot become detached from the pouring element and fall into the package interior. On the contrary it remains in the end position, and the piece of composite material, formed by the cutting edge 10 but not entirely detached, is bent perpendicularly downwards, so that the complete clear cross section of the opening element 2 is available for pouring out.

The invention claimed is:

1. A re-closable pouring element for liquid foods packaged in cardboard/plastic composite packages, comprising:

a base encircled by a flange and having both a solidly constructed inner thread and an outer thread;

an opening element having at least one cutting edge; and a screw cap formed as a threaded lid, wherein the opening element has a solidly constructed helical outer thread and is arranged inside the base and wherein the opening element is formed in such a way that when the cap is operated for the first time, it cuts an opening in the package material located under the pouring element, wherein the helical outer thread of the opening element is reduced or interrupted in the lower section at least in one region and the inner thread of the base is likewise reduced or interrupted at least in a corresponding region, so that during initial assembly the opening element can be moved into the base axially from above without screwing in, pressing or over-compressing the inner thread of the base and the outer thread of the opening element, the reduced or interrupted portion of the helical outer thread is positioned along a helical path of the helical outer thread with continuous portions of the helical outer thread positioned on opposite sides of the reduced or interrupted portion.

2. The pouring element according to claim 1, wherein the outer thread of the opening element is reduced or interrupted at two diametrically opposed regions.

3. The pouring element according to claim 1, wherein the outer thread of the opening element has two intermeshing threads.

4. The pouring element according to claim 3, wherein each intermeshing thread embraces the opening element by at least 540° .

5. The pouring element according to claim 3, wherein the outer thread of the opening element is reduced or interrupted in each case in the lower intermeshing thread.

6. The pouring element according to claim 1, wherein each outer thread of the opening element at its upper end has at least one limit stop.

7. The pouring element according to claim 1, wherein the at least one cutting edge is suitable both for piercing the cardboard/plastic composite material and for cutting out an opening for pouring.

8. The pouring element according to claim 7, wherein the cutting edge is formed in such a way that when turning into the package material, the cut length for farming the opening for pouring is less than a complete circle.

9. The pouring element according to claim 2, wherein the base has a plurality of diametrically opposed threaded sections in the interior.

10. The pouring element according to claim 1, wherein at least one limit stop is provided in the lower region of the base for the opening element which is unscrewed downwards.

11. The pouring element according to claim 1, wherein the opening element has a plurality of projections distributed over its interior.

12. The pouring element according to claim 11, wherein the screw cap has in its interior at least one driving bar, which extends from the top side of the screw cap, bends concentrically downwards and interacts in a ratchet-like manner with the projections.

13. The pouring element according to claim 1, wherein the screw cap in a fitted position is connected to the base by material bridges serving as predetermined breaking points.

14. The pouring element according to claim 13, wherein the material bridges run between the screw cap and a mounting plate, and wherein the mounting plate is connected to the flange of the base.

15. A method for assembling a pouring element having a base encircled by a flange and including both a solidly constructed inner thread and an outer thread, an opening element having at least one cutting edge, and a screw cap formed as a threaded lid, wherein the opening element has a solidly constructed helical outer thread and is arranged inside the base and wherein the opening element is formed in such a way that when the cap is operated for the first time, it cuts an opening in the package material located under the pouring element, wherein the helical outer thread of the opening element is reduced or interrupted in the lower section at least in one region and the inner thread of the base is likewise reduced or interrupted at least in a corresponding region, so that during initial assembly the opening element can be moved into the base axially from above without screwing in, pressing or over-compressing the inner thread of the base and the outer thread of the opening element, the reduced or interrupted portion of the helical outer thread is positioned along a helical path of the helical outer thread with continuous portions of the helical outer thread positioned on opposite sides of the reduced or interrupted portion, the method comprising the steps of:

a) aligning radially and moving the opening element into the base axially from above, and b) fitting the screw cap at the same time or afterwards.

* * * * *

UNITED STATES PATENT AND TRADEMARK OFFICE

CERTIFICATE OF CORRECTION

PATENT NO. : 7,959,032 B2
APPLICATION NO. : 11/916756
DATED : June 14, 2011
INVENTOR(S) : Felix Bolli It is certified that error appears in the above-identified patent and that said Letters Patent is hereby corrected as shown below:

Column 6, Line 10, Claim 8, “farming” should read -- forming --

Signed and Sealed this
Eighteenth Day of October, 2011

David J. Kappos

David J. Kappos
*Director of the United States Patent and Trademark Office*